United States Patent [19]

Dieterich

[11] Patent Number: 4,630,652

[45] Date of Patent: Dec. 23, 1986

[54] METHOD FOR FORMING A FLAT BAND OF PARALLEL, CONTIGUOUS STRANDS

[76] Inventor: Frank L. Dieterich, 5113 Miembro, Laguna Hills, Calif. 92653

[21] Appl. No.: 749,988

[22] Filed: Jul. 1, 1985

[51] Int. Cl.[4] ..... B21F 3/04

[52] U.S. Cl. ..... 140/92.1; 29/419 R

[58] Field of Search ..... 140/71 R, 92.1, 102, 140/92.2; 29/605, 419; 242/7.14

[56] References Cited

U.S. PATENT DOCUMENTS

| | | | |
|---|---|---|---|
| Re. 30,489 | 1/1981 | Abbott . | |
| 2,650,638 | 9/1953 | Johnson et al. . | |
| 2,704,103 | 3/1955 | Wirth . | |
| 2,801,805 | 8/1957 | Johnson . | |
| 2,920,348 | 1/1960 | Franke, Jr. . | |
| 2,982,888 | 5/1961 | Whearley . | |
| 3,024,497 | 3/1962 | Hardesty et al. . | |
| 3,154,451 | 10/1964 | MacDougall . | |
| 3,585,705 | 6/1971 | Allan | 29/419 |
| 4,080,915 | 3/1978 | Bompard et al. . | |
| 4,118,262 | 10/1978 | Abbott . | |
| 4,347,873 | 9/1982 | Caras | 140/92.1 |

FOREIGN PATENT DOCUMENTS

| | | | |
|---|---|---|---|
| 18811 | 10/1966 | Japan | 140/92.1 |
| 143132 | 11/1979 | Japan | 29/605 |
| 757811 | 9/1956 | United Kingdom | 140/71 R |

*Primary Examiner*—Lowell A. Larson

*Attorney, Agent, or Firm*—Pretty, Schroeder, Brueggemann & Clark

[57] ABSTRACT

A method for fabricating a flat band of parallel, contiguous strands or wires using just a single strand or wire. Wire is wound onto a drum to produce a single-wire helix having a predetermined pitch, after which the same wire is wound in a reverse direction onto the drum to produce a second single-wire helix contiguous with the first one. These two winding steps are repeated until a helix having the desired number of contiguous wires has been formed. Unwinding the multi-wire helix from the drum produces the desired flat band of parallel, contiguous wires.

6 Claims, 8 Drawing Figures

METHOD FOR FORMING A FLAT BAND OF PARALLEL, CONTIGUOUS STRANDS

BACKGROUND OF THE INVENTION

This invention relates generally to methods for forming flat bands of parallel, contiguous strands, and, more particularly, to methods for forming such bands using just a single strand.

Flat bands of parallel, contiguous strands are useful for a number of purposes. For example, the strands can be in the form of wire and the band can be used to produce miniature potentiometer spring contacts. The contiguous wires (e.g., 30 in number) of such contacts are joined together at one end, and the free ends form a set of fingers for making electrical contact with a resistance surface. Examples of such miniature spring contacts and methods for making them are described in U.S. Pat. Nos. 3,579,822, 3,733,573, 3,735,079 and 3,755,892, all in the name of Frank L. Dieterich.

In the past, such long multi-strand bands have typically been formed by joining together wires dispensed from a number of separate spools. This technique has not proven to be entirely satisfactory, primarily because the wires are usually very fine (e.g., 0.002 to 0.005 inches in diameter) and wire damage and breakage can frequently occur. The breakage of just a single wire of the 30 being brought together will usually require a costly interruption in the manufacturing process.

It should therefore be appreciated from the foregoing that there is a definite need for an improved method for producing a lengthy band of parallel, contiguous strands or wires, which is not susceptible to frequent manufacturing interruptions. The present invention fulfills this need.

SUMMARY OF THE INVENTION

The present invention resides in a flat band of parallel, contiguous strands and in a method for forming such a band using just a single strand. Such a band is useful in a number of applications, such as in the formation of spring contacts for miniature potentiometers. The method of the invention is reliable and relatively inexpensive to implement, and it substantially reduces the possibility of costly manufacturing interruptions and material losses.

More particularly, the method of the invention includes the initial formation of a helix having a predetermined plurality of strands per turn. In an initial step, a single strand (e.g., wire) is wound in a first direction around a mandrel to form a first single-strand helix having a substantially constant pitch. The strand is then secured to the far end of the mandrel and wound in the opposite direction around the mandrel, contiguous with the first helix, to form a double-strand helix. The first and second winding steps are repeated in an alternating fashion as many times as required to produce a predetermined plurality of parallel, contiguous strands in each turn of the helix. Each successive winding is contiguous with the second previous winding.

The successive winding steps are preferably performed using a mandrel in the form of a reversibly rotatable cylindrical drum and a wire supply that is translatable alongside the rotating drum. Separate terminal posts project radially outwardly from each end of the drum. To initiate the winding of wire onto the drum, the wire supply is positioned a short distance radially outwardly from the drum, in alignment with one terminal post. The leading end of the wire is wound around the post and attached to the drum, and the drum is then rotated in a particular direction. Simultaneously, the wire supply translates parallel to the drum axis toward the other terminal post. The wire thereby wraps around the drum to form a single-wire helix. The relative rotation and translation rates of the drum and wire supply are preferably constant, and are selected to provide a predetermined constant space between successive turns of the helix.

Drum rotation and wire supply translation stop when the wire supply reaches the opposite axial end of the drum and the wire is aligned with the second terminal post. The wire supply is then swung in a 180 degree arc around the end of the drum to the drum's radially opposite side, so that the wire is wrapped around the second terminal post. Thereafter, the drum rotates in an opposite direction and the wire supply translates along the drum axis back toward the first terminal post. This causes the wire to wrap around the drum and form a second helix, contiguous with the first helix. When the wire supply reaches the initial axial end of the drum, in alignment with the first terminal post, drum rotation and wire supply translation stop. The wire supply is then swung in a 180 degree arc around the end of the drum to wrap the wire around the first terminal post. The wire supply is thereby again located in its initial position relative to the drum.

This sequence of steps is repeated as many times as necessary to produce the desired number of wire strands in each turn of the helix. When the desired number has been obtained, the end of the wire may be cut and secured in a suitable manner to the terminal post where the winding sequence terminates.

The initial pitch of the helix is preferably selected such that after the desired number of wire turns have been wound onto the drum, a solid helix is produced, with substantially no gap between the helix's successive turns. The individual wires of the multi-wire helix can be secured to each other, to maintain their parallel, contiguous relationship, by soldering or other suitable process.

Following formation of the multi-wire, solid helix, the helix can be removed from the drum to produce the desired flat band of parallel, contiguous wires. This band has a length several orders of magnitude longer than the drum's circumference. The solid helix can be subdivided into a plurality of bands, each having a lesser number of parallel, contiguous strands to be unwound individually from the drum.

Other aspects and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENT

As shown in the accompanying drawings, the present invention resides in a flat band of parallel, contiguous wires formed using just a single wire 10 dispensed from a supply spool 12. The wire is initially wound onto a cylindrical mandrel or drum 14 to form a helix having a predetermined number of parallel, contiguous wires in each turn. The multi-wire helix is then removed from the drum to produce the long band of parallel, contiguous wires. This band can be used, for example, in producing a great number of spring contacts for miniature potentiometers. Since the multi-wire band is formed using just a single wire, interruptions in the winding process are minimized and the band can be formed with high efficiency.

The drum 14 is rotated and the supply spool 12 is translated axially relative to the drum in such a fashion as to wind onto the drum a sequence of individual single-wire helixes. Each such helix has a predetermined constant pitch and is parallel to, and contiguous with, a previous single-wire helix. Terminal posts 16 and 18 project radially outwardly from axially opposite ends of the drum, for use in reversing the direction of successive helical winds.

Figure 1:
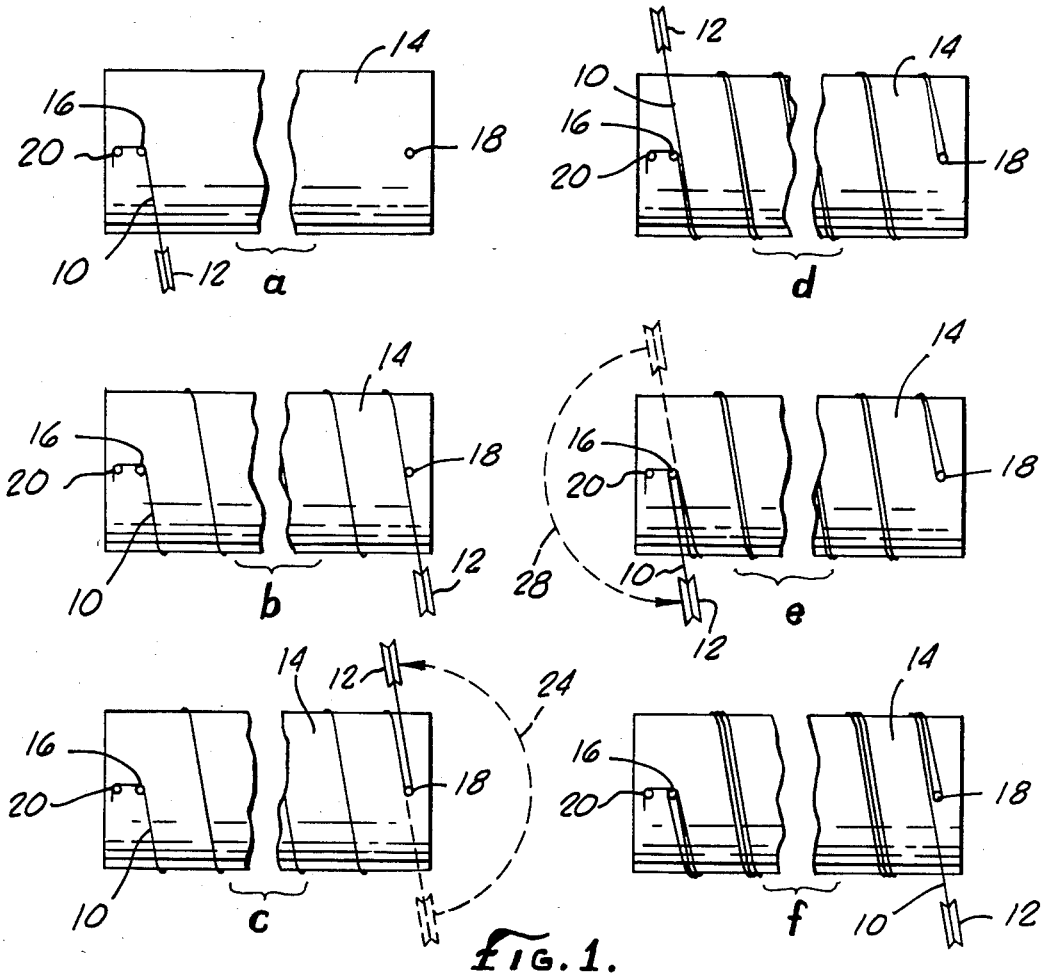
FIGS. 1(*a*)–1(*f*) are diagrammatic views showing the initial steps of the invention, for winding a single wire around a cylindrical drum to produce a multi-wire helix.

FIGS. 1(*a*)–1(*f*) depict diagrammatically the sequence of steps in the present method of invention, in winding the single wire 10 onto the drum 14 to form a multi-wire helix. The winding begins (FIG. 1(*a*)) with the supply spool 12 located adjacent to the first terminal post 16 and the wire wrapped around the post and secured to the drum by a screw 20 or the like. The drum begins rotating counterclockwise (as viewed from the left), while the spool simultaneously begins translating to the right relative to the drum. Actually, the spool preferably remains stationary and a wire guide (not shown) translates axially relative to the drum. For ease of understanding, however, FIGS. 1(*a*)–1(*f*) depict the spool as translating.

The specified drum rotation and spool translation cause wire to be dispensed from the spool to form a single strand helix 22 (FIG. 1(*b*)) on the drum. A slight drag in the spool ensures adequate tension in the helical wind. The translation and rotation rates bear a constant relationship, such that the single-strand helix 22 has a predetermined, constant pitch.

Spool translation and drum rotation are simultaneously stopped when the spool 12 reaches the right end of the drum 14, with the wire 10 located immediately adjacent to the second terminal post 18. The last point of contact between the wire the drum is a point immediately to the left of the post. This condition is depicted in FIG. 1(*b*).

To properly set up the spool 12 to wind a second helix onto the drum 14, the spool is now moved in a 180 degree arc around the second terminal post 18, to the opposite side of the drum. This arcing movement is depicted by the dotted line 24 in FIG. 1(*c*) . The spool then translates back to the left while the drum simultaneously rotates clockwise (as viewed from the left). This forms a second helical winding 26, immediately adjacent to the first helical winding 22. A slight pressure applied laterally to the wire 10, in the direction of the spool's translating movement, ensures that the second winding remains contiguous with the first winding. A piano wire (not shown) can be used conveniently to apply this pressure to the wire.

When the spool 12 reaches the left end of the drum 14, further spool translation and drum rotation are stopped. The last point of contact between the wire 10 and the drum is adjacent to the first terminal post 16, with the first winding 22 sandwiched between point of contact and the post, as depicted in FIG. 1(*d*).

The spool 12 is now moved in a 180 degree arc around the first terminal post 16 and the left end of the drum 14, to position the spool in the same location it was in when the initial winding was begun. This arcing movement is depicted by the dotted line 28 in FIG. 1(*e*), and it is a mirror image of the first arcing movement 24, depicted in FIG. 1(*c*).

In the position depicted in FIG. 1(*e*), the spool 12 and drum 14 are ready to wind a third helical winding 30 (FIG. 1(*f*)) onto the drum. As with the first helical winding 22, the third winding is formed by translating the spool to the right while simultaneously rotating the drum counterclockwise (as viewed from the left). Again, a lateral pressure applied to the wire 10 being dispensed, in the direction of spool translation, ensures that the third winding remains contiguous with the first winding.

Figure 2:
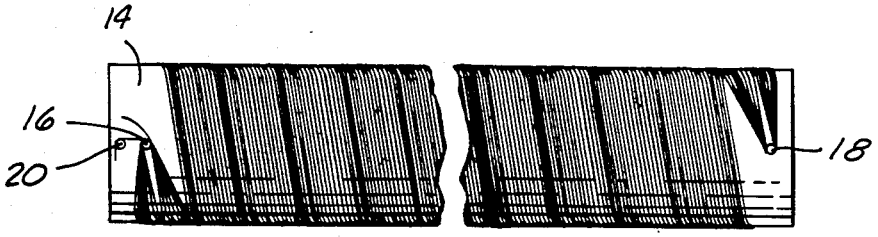
FIG. 2 is a simplified view of the cylindrical drum of FIG. 1 after the multi-wire solid helix has been completely formed.

The above sequence of steps is repeated as many times as required to form a helix with the desired number of contiguous wires per turn. FIG. 2 depicts the final multi-wire, solid helix. The pitch between successive turns of the individual helical windings is preferably selected such that when the multi-wire helix has been completed there is a negligibly small gap remaining between its successive turns. This allows formation of a multi-wire band having the greatest length.

Figure 3:
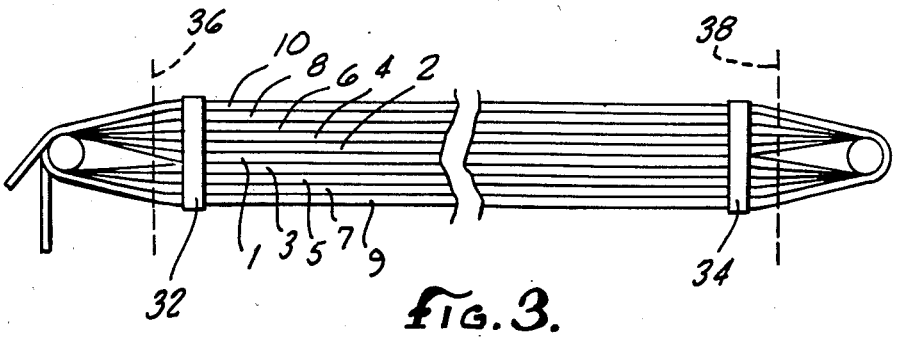
FIG. 3 is a fragmentary view of a multi-wire band removed from the cylindrical drum of FIGS. 1 and 2, with the individual wires in the band being numbered according to the sequence in which they were wound.

To hold the individual wires of the helix in their predetermined contiguous positions, end bars 32 and 34 are soldered across the ends of the multi-wire band, as depicted in FIG. 3. These end bars are soldered in place before the band is removed from the drum 14. In addition, a uniform series of cross bars (not shown) can be placed across the contiguous wires of the band, before or after removal from the drum.

FIG. 3 depicts the multi-wire helix after it has been unwound from the drum 14. Although the band is depicted with merely 10 separate windings, it will be appreciated that it can have any desired number. Each wire in the band is numbered consecutively, in the order it was wound onto the drum. The two ends of the band can be cut off, as indicated by the dotted lines 36 and 38, to permit the solid helix to be subdivided into narrower bands, as desired. The subdivided bands can be unwound directly from the drum.

In the preferred embodiment, the drum 14 has a diameter of about 8 inches and a length of about 10 inches. The drum is preferably formed of stainless steel, which makes it suitable for use as a cathode in any electroplating process. The stainless steel is preferably passivated, so that any plating will not adhere to it. The posts 16 and 18 can conveniently have a diameter of about 0.0625 inches. If wire having a diameter of about 0.005 inches is wound onto the drum with a pitch of 0.050 inches, a 10-wire helix can be formed. Removing the helix from the drum produces a flat 10-wire band approximately 5000 inches long. Depending on the ultimate use of the multi-wire band, the wire either can be bare or can have an insulating coating.

It should be appreciated from the foregoing description that the present invention provides a unique flat band of parallel, contiguous strands, using a special method in which a multi-strand helix is first formed using just a single wire. The wire is dispensed onto a reversibly-rotatable mandrel from a wire supply that is reversibly translatable relative to the mandrel. A long band of contiguous, parallel strands is thereby produced, for use in making, for example, spring contacts for miniature potentiometers.

Although the invention has been described in detail with reference to the presently preferred embodiment, it will be appreciated that those skilled in the art can make various modifications to the disclosed embodiment without departing from the invention. Accordingly, the invention is defined only by the following claims.

I claim:

1. A method of forming a flat band of parallel, contiguous strands, comprising steps of:

winding a single strand in a first direction around a mandrel, to form a single-strand helical winding having a substantially constant pitch;

winding the single strand in a second, opposite direction around the mandrel, contiguous with the previous single-strand helical winding, to form a double-strand helical winding;

repeating the first and second winding steps in an alternating fashion until a multi-strand helical winding having a predetermined plurality of parallel, contiguous strands has been wound, each successive winding being contiguous with the second previous winding; and removing the multi-strand helical winding from the mandrel to produce a flat band of parallel, contiguous strands.

2. A method as defined in claim 1, wherein the step of repeating the first and second winding steps is continued until substantially no gap remains between the successive turns of the multi-strand helical winding, thus forming a solid winding.

3. A method as defined in claim 1, wherein:

the method further includes a step of subdividing the multi-strand helical winding into a plurality of helical windings, each having fewer than the predetermined plurality of strands; and the step of removing includes steps of separately removing the subdivided helical windings from the mandrel to produce a plurality of flat bands of parallel, contiguous strands.

4. A method as defined in claim 1, wherein:

the mandrel is cylindrical and rotatable and the strand is dispensed from a wire supply that is translatable relative to the mandrel;

the first step of winding includes steps of rotating the mandrel at a constant rate in a first direction and translating the wire supply from a first end of the mandrel to a second end of the mandrel, along a first side of the mandrel; and the second step of winding includes steps of rotating the mandrel at a constant rate in a second direction, opposite the first direction, and translating the wire supply from the second end of the mandrel to the first end of the mandrel, along a second side of the mandrel, opposite the first side.

5. A method as defined in claim 4, wherein:

the mandrel includes a first post projecting radially outwardly from its first end and a second post projecting radially outwardly from its second end; and the method further includes a step between each successive winding step of moving the wire supply from one side of the mandrel to the other while simultaneously wrapping the strand around either the first post or the second post.

6. A method of forming a flat band of parallel, contiguous wires, comprising steps of:

securing one end of a length of wire to a rotatable drum;

winding the wire around the drum to form a first helix having a substantially constant pitch;

securing the wire at the end of the first helix to the drum;

reverse winding the wire around the drum to form a second helix having the same pitch as the first helix, the second helix being parallel to, and contiguous with, the first helix;

securing the wire at the end of the second helix to the drum;

repeating the steps of winding and reverse winding until a predetermined number of helixes have been wound, each helix being parallel to, and contiguous with, a previously-wound helix, whereby a multi-wire helix having a predetermined plurality of contiguous wires per turn is produced; and unwinding the multi-wire helix from the drum to produce a flat band of parallel, contiguous wires.

* * * * *